US009080741B2

(12) United States Patent
Mignot et al.

(10) Patent No.: US 9,080,741 B2
(45) Date of Patent: Jul. 14, 2015

(54) LIGHT ENGINE HAVING MAGNETIC SUPPORT

(75) Inventors: Nicolas Mignot, Genas (FR); Benoit Georges Paul Tothe, Lyons (FR)

(73) Assignee: Koninklijke Philips N.V., Eindhoven (NL)

( * ) Notice: Subject to any disclaimer, the term of this patent is extended or adjusted under 35 U.S.C. 154(b) by 291 days.

(21) Appl. No.: 13/518,947

(22) PCT Filed: Dec. 22, 2010

(86) PCT No.: PCT/IB2010/056009

§ 371 (c)(1),
(2), (4) Date: Jun. 25, 2012

(87) PCT Pub. No.: WO2011/093386

PCT Pub. Date: Jul. 14, 2011

(65) Prior Publication Data

US 2012/0293998 A1 Nov. 22, 2012

(30) Foreign Application Priority Data

Jan. 5, 2010 (EP) ..... 10305010

(51) Int. Cl.

| | |
|---|---|
| ***F21V 21/096*** | (2006.01) |
| ***F21V 5/00*** | (2015.01) |
| ***F21V 7/00*** | (2006.01) |
| ***F21V 17/10*** | (2006.01) |
| ***F21V 29/00*** | (2015.01) |
| ***F21V 29/85*** | (2015.01) |
| *F21Y 101/02* | (2006.01) |
| *F21Y 105/00* | (2006.01) |

(52) U.S. Cl.

CPC ..... *F21V 5/007* (2013.01); *F21V 7/0083* (2013.01); *F21V 17/105* (2013.01); *F21V 29/004* (2013.01); *F21V 29/85* (2015.01); *F21Y 2101/02* (2013.01); *F21Y 2105/001* (2013.01)

(58) Field of Classification Search

USPC ..... 362/236, 237, 240, 244, 249.01, 362/249.02, 398

See application file for complete search history.

(56) References Cited

U.S. PATENT DOCUMENTS

| | | | | |
|---|---|---|---|---|
| 6,663,260 | B1 * | 12/2003 | Tieszen | 362/249.06 |
| 6,810,612 | B2 * | 11/2004 | Huang | 40/452 |
| 6,955,455 | B2 * | 10/2005 | Schneider | 362/398 |
| 7,145,179 | B2 * | 12/2006 | Petroski | 257/81 |
| 7,997,774 | B2 * | 8/2011 | Liddle | 362/398 |
| 8,371,728 | B2 * | 2/2013 | Hente et al. | 362/398 |
| 8,536,772 | B2 * | 9/2013 | Kim et al. | 313/153 |
| 8,651,711 | B2 * | 2/2014 | Rudisill et al. | 362/398 |
| 2009/0086478 | A1 | 4/2009 | Sanroma et al. | |
| 2010/0135020 | A1 * | 6/2010 | Moore | 362/249.02 |

(Continued)

FOREIGN PATENT DOCUMENTS

| | | | |
|---|---|---|---|
| DE | 202007017609 | U1 | 4/2008 |
| DE | 102008021127 | A1 | 11/2009 |

(Continued)

*Primary Examiner* — Ismael Negron

(74) *Attorney, Agent, or Firm* — Meenakshy Chakravorty

(57) ABSTRACT

A light device includes a light engine having light emitting device, an optical device, and at least a first magnetic element disposed between the light emitting device and the optical device. The light device further includes a support holder having a magnetic material adapted to couple to the at least one magnetic element, to magnetically attach the light engine to the support holder.

11 Claims, 4 Drawing Sheets

(56) References Cited

U.S. PATENT DOCUMENTS

| | | | | |
|---|---|---|---|---|
| 2010/0271834 | A1* | 10/2010 | Muessli | 362/398 |
| 2012/0224373 | A1* | 9/2012 | Snijder et al. | 362/249.01 |
| 2013/0229802 | A1* | 9/2013 | Fukushima et al. | 362/235 |

FOREIGN PATENT DOCUMENTS

| | | | |
|---|---|---|---|
| EP | 1998105 | A1 | 12/2008 |
| WO | 9202117 | | 2/1992 |
| WO | 2008122941 | A1 | 10/2008 |

* cited by examiner

LIGHT ENGINE HAVING MAGNETIC SUPPORT

FIELD OF THE INVENTION

The invention relates to a light engine comprising:

a light-emitting device comprising at least one light source;

an optical device attached to the light-emitting device;

The light-emitting device of such a light engine may comprise at least one Light-Emitting Diode (LED) as a light source and a circuit board to carry, supply power to and potentially control the LED(s).

Typically, such a light engine is held in a luminaire by a carrier through which the power may be supplied to the light engine. In the case of LED luminaire, this carrier may be also arranged as a heat dissipater, like a heat sink, which further allows the dissipation of the heat from the LEDs.

The invention relates in particular to the coupling of the light engine to the carrier.

BACKGROUND OF THE INVENTION

Different techniques for attaching a light engine to a carrier are known, such as screwing or providing an adhesive layer between the light engine and the carrier.

These techniques of attachment needs additional tool and/or equipment, and are therefore not convenient to implement.

US2009/0086478 discloses a light-emitting system comprising a LED module (i.e. a light engine) magnetically attached to a heat-dissipative frame (i.e. said carrier). The magnetic attachment is obtained by providing the frame with a magnetic material (permanent magnet or soft magnetic material) and the LED module with a magnetic element (made of a permanent magnet or a soft magnetic material).

Therefore this document proposes a light-emitting system allowing the user to attach and detach very easily the LED module and the frame, needless of tools or adhesive materials.

The LED module comprises the LED chip and a base carrying the LED chip, the base comprising electrical conductive paths allowing the power supply of the LED chip, dielectric material, and said magnetic element such that the magnetic element is located between the LED chip and the frame.

Therefore the light-emitting system is made from three stacked elements (LED chip, base and frame).

Moreover the magnetic element is made of a thermal conductive material to conduct the heat from the LED chip to the frame, and significantly contributes accordingly to the heat dissipation. To satisfy an efficient heat conductivity, the mass of the magnetic material embedded in the magnetic element must be large enough.

Furthermore, the heat dissipation is not optimum due to the presence of intermediate materials between the LED chip, the magnetic element and the frame (electrical conductive and dielectric materials).

SUMMARY OF THE INVENTION

The invention is aimed at solving the above mentioned problems from the prior art by proposing, according to a first embodiment, a light engine comprising:

a light-emitting device comprising at least one light source;

an optical device attached to the light-emitting device; and at least one first magnetic element between the light-emitting device and the optical device.

Without any limitation, the first magnetic element may be of a soft magnetic material (e.g. iron), and/or a permanent magnet (e.g. NdFeB, Ferrite, SmCo, AlNiCo, etc.) and/or an electromagnet with possibly a core made of a soft magnetic material.

This first magnetic element allows a user to magnetically attach and detach the light engine to a support holder including an adapted magnetic material, without need of specific tool and adhesive materials. For example, the first magnetic element may be made of a soft magnetic material (e.g. iron) and the adapted magnetic material is a permanent magnet; or the first magnetic element may be made of a permanent magnet and the adapted magnetic material is a soft magnetic material; or the first magnetic element may be made of a first permanent magnet having a first polarity and the adapted magnetic material is a second permanent magnet having a second polarity having the same polarity as the first polarity; the first magnetic element and/or the support holder may comprise an electromagnet with possibly a core made of a soft magnetic material.

Said support holder and the optical device being typically on either side of the light-emitting device, the first magnetic element of the light engine according to the invention is not located between the light-emitting device and the support holder, preventing accordingly the stacked configuration of prior art, but on a surface of the light-emitting device opposite the interface between the light-emitting device and the support holder. Therefore, due to the specific configuration of the light engine according to the invention, the first magnetic element may be provided in a location of the light engine (e.g. offset from the light source) where it does not increase significantly the volume of the light engine (e.g. at a location where the light engine is thinner). Furthermore, since the first magnetic element is not necessarily located between the light source and the support holder, it must not necessarily contribute to the heat dissipation from the light source through the support holder (e.g. when the light source is a LED and the support holder is a heat dissipater, such as for example a heat sink): accordingly the material of the first magnetic element is not necessarily chosen as a heat conductive material. A designer of the light engine has therefore more choices regarding the materials to be chosen for the first magnetic element. Moreover the mass of the first magnetic element may also be minimized, limiting thus the volume and weight of the light engine.

Furthermore, by sandwiching the first magnetic element between the optical device and the light-emitting device, the first magnetic element may be held without need of tool or adhesive material to maintain the first magnetic element in the light engine that could hamper the heat dissipation from the light source through the support holder. Moreover, the invention improves the reliability of the light device, with respect to a light device comprising an adhesive bonding whose reliability is questionable over time.

Optionally, the light engine is further described according to the claims. By providing such a cavity in the optical device and/or the light-emitting device, the first magnetic element can be lodged in the cavity, protecting it against external aggression (mechanical, chemical, etc.). Moreover, this configuration allows to minimize the impact of the presence of this first magnetic element on the size and volume of the light engine.

Optionally, the light engine is arranged according to the claims. By providing such offset, the first magnetic magnet is decayed from the light source and does not interfere in the heat transfer between the light source and said support holder. Moreover, by this way, a cumbersome and complicated stacking of optical device/light source/first magnetic element/support holder is avoided, and the light engine is therefore less cumbersome.

Optionally, the light engine is arranged according to the claims. Especially, the area(s) of the circuit board dedicated to be in contact with the first magnetic element(s) may be provided without any circuitry. Therefore the circuit board can be made in such a way that the first magnetic element(s) does not contact the circuitry. Furthermore, the circuit board can be designed in a multiple way to define a multiple of magnetic—electric configurations. In particular, the first magnet element (s) may be located far from the heat source and/or electronic components to avoid any lateral heat dissipation and/or magnetic interferences with the electronic components. Optionally, some magnetic shielding may be provided around at least a part of the first magnetic element to avoid any magnetic interferences. However the applicant has already noticed that such magnetic fields have not or negligible harmful effects on the LEDs operations.

This particular embodiment allows the electrical plugging of the light engine to external power supply and, potentially external controller, transversally to the circuit board. This connection is less cumbersome than a horizontal plugging (i.e. parallel to the surface of the circuit board). Additionally, some counter connecting device may also be provided on the support holder, as claimed in the claims. Therefore the support holder and the light engine are assembled mechanically and electrically transversally to the circuit board. Moreover, if the support holder and/or the light engine comprise some guiding means to assist the assembly of one onto the other, the electrical plugging may also be guided by this mechanical assembly, due to its transversal configuration, which allows a correct alignment of the first and second corresponding plugging elements.

Optionally, the light engine is arranged according to the claims, allowing the parameters (shape, illuminance, etc.) of the light emitted from the light source to be tailored according to the desired light effect. Especially, the invention allows the optical designer to freely design the optical lens(es). For example the lens may be spherical, quadric, with convergent and/or divergent diopters, a lens according to WO2008/122941.

Optionally, an array or a matrix of light sources (e.g. LEDs) can be provided in the light engine, to spread and/or increase the intensity and/or dim and/or tune the light emitted by the light engine. Associated with the circuit board, multiple light effects can be designed and controlled.

Optionally, the light engine is assembled according to the claims. The light-emitting device is assembled to the optical device at a plurality of attaching local areas. By providing a homogeneous distribution of these attaching local areas over a main surface of the light engine, the attachment can be done homogeneously. Furthermore, due to the force of attachment is intended to be spread over the light engine at a plurality of small local areas, each local attachment may be performed by technique of attachment requiring only a few energy with respect to a macro attachment: problems of damages (e.g. in electronics and circuitry in the light-emitting device), when using this technique, can therefore be minimized. This risk of damages or perturbation is all the more minimized than the local attachment areas are offset from the light sources, protecting therefore the light sources from any risk occurred when the attachment occurs. Optionally, this attachment is performed by welding according to the claims: by welding the optical device to such a "back surface" of the light-emitting device, the "front surface" of the light-emitting device (which comprises the light source and potentially some circuitries and electronic components, and which is in contact with the optical device) is protected from the welding operation.

According to a second embodiment, the invention proposes a light device according to the claims, which comprises said light engine and a support holder bearing the light engine, the light engine being magnetically attached to the support holder thanks to the first magnetic element and a magnetic material comprised in the support holder. This support holder may be a heat sink which dissipates heat from the light engine, and especially from the light source(s). In latter case, and as aforementioned, the heat dissipation is improved by preventing to provide the first magnetic element between the light-emitting device and the support holder.

Optionally, said magnetic material in the support holder is comprised of at least one second magnetic element facing one first magnetic element or each corresponding first magnetic element. By locating the second magnetic element in front of the corresponding first magnetic element, the size, volume and mass of the second magnetic element can be optimized for obtaining a determinate magnetic attractive force between the light engine and the support holder. Therefore the quantity and cost of magnetic material in the support holder can be minimized. Furthermore, the quantity of heat-dissipative material in the support holder can be maximized, improving accordingly the efficiency of the heat dissipation. Moreover, if the second and first magnetic materials are respectively distributed homogeneously over, respectively, the light engine and the support holder, the magnetic attractive force is accordingly also homogeneously distributed over the interface between the light engine and the support holder, leading to a more efficient attachment. Alternatively, the first and second magnetic elements may be distributed inhomogeneously to obtain an inhomogeneous attractive force at said interface. Latter may be useful if a part of the support holder is heavier than other parts of the light device: the attractive force exerted on this heavier part can therefore be different from the attractive force exerted on the less heavy parts.

Optionally, at least one first magnetic element is made of a permanent magnet and at least one second magnetic element is made of a soft magnetic material. By doing this, the size of the first magnetic element may be minimized, and the volume/mass of the light engine can therefore be also minimized.

Optionally, at least a protruding element protrudes from the surface of the support holder located at the interface with the light engine, and the surface of the light engine located at the interface with the support holder comprises at least one opened cavity designed to house this protruding element. The protruding element allows a good positioning of the light engine with respect to the support holder. It may help also to a good electrical connection between the aforementioned connecting transversal elements. In a particular case, this protruding element may be a protrusion part of the second magnetic element: the magnetic attraction between the first magnetic elements and the second magnetic elements provide accordingly a further assistance to the positioning, such force guiding the right positioning of the light engine onto the support holder by a manufacturer or a machine. Furthermore, this specific configuration allows a close contact between the first and second magnetic elements, maximizing therefore the magnetic attractive force between them, strengthening accordingly the attachment of the light engine to the support holder.

It is to be noticed the use of the terms "light engine" should not limit the invention, and must be understood broadly. For example, the terms "light engine" can be replaced without any limitation by the terms "light module" everywhere in the description and claims.

DETAILED DESCRIPTION OF THE INVENTION

Figure 1:
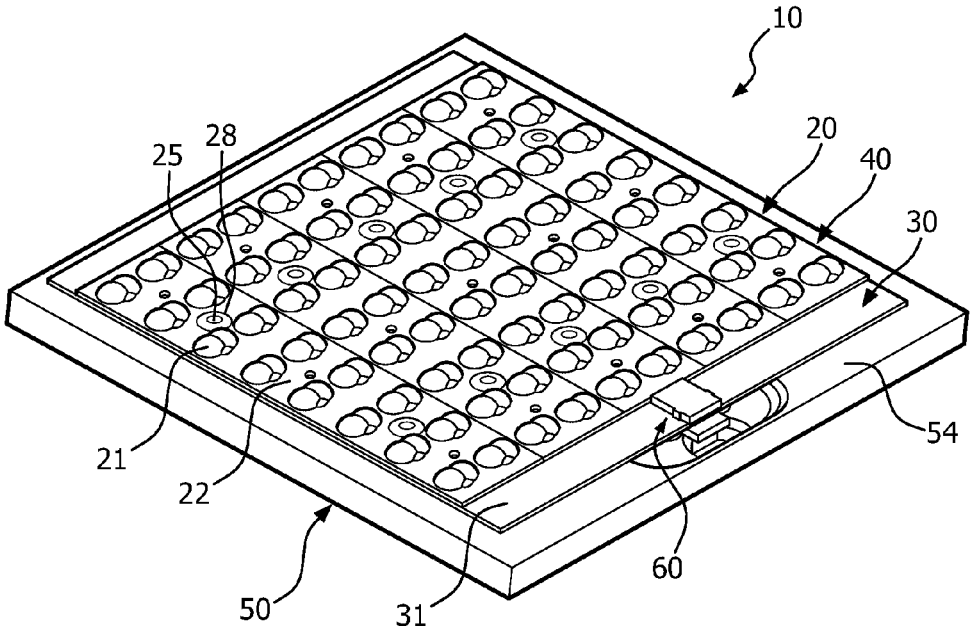
FIG. 1 is a top perspective view of a light device according to an exemplary embodiment of the invention.

FIG. 1 through FIG. 6 depicts a particular embodiment of the invention corresponding to a light device 10, comprising a light engine 40 and a support holder 50 bearing the light engine 40. The light engine 40 comprises an optical device 20 and a light-emitting device 30 attached one to the other.

The light-emitting device 30 comprises, according to this particular embodiment, Light-Emitting Diodes ("LEDs") as light sources (not shown). The light-emitting device 30 may also comprise a circuit board with a circuitry, and potentially some electronic components, arranged to distribute electrical power, and potentially control signals, to the LEDs. The circuit board may also comprise some electronic components to control, adjust and/or tune signals and/or supply power. The circuit board may be equipped with a first connecting device 61, for example at an end portion 31 of the light-emitting device 30. This first connecting device 61 may be arranged to be connected with a counter-connecting device 62, so as to power supply, and possibly control supply, the circuit board and the LEDs from external power source and controllers (not shown).

The light-emitting device 30 may comprise one or a plurality of LEDs. In latter case, these LEDs may be arranged according to a row or a matrix, one cell of the row or the matrix may comprise one or a plurality of LEDs.

Optionally the light-emitting device 30 extends generally along a main surface, preferably a plane.

The optical device 20 comprises an optical structure and properties which allow that at least a part of the light energy produced by the LEDs is transmitted through the optical device 20 in such a way that the light engine 40 emits some optical beam or radiation with specific properties, such as wavelengths, shapes, dimensions, luminance, brightness, directions, etc. In particular some lenses 21 may be provided with an internal cavity (i.e. input diopter) to house the LED or group of LEDs. The output diopter is determined by the external shape of the lens 21. The internal and external diopters are designed according to the light effect to be obtained. In particular, the internal and external diopters may be any surface, e.g. semi-spherical; quadric; symmetrical with respect to a plane and/or an axis perpendicular to the optical centerline of the LED, to a plane or an axis parallel to the optical centerline of the LED; asymmetrical according to a plane or an axis; divergent and/or convergent; or a combination thereof. The non-limitative example of this particular embodiment of the invention uses some lenses having a semi-"peanut" shape as disclosed in WO2008/122941. A lens 21 may be transparent or colored, or may comprise some elements able to change the optical wavelengths emitted by the LED (such elements may include for example a luminescent material). Between lenses 21 of the optical device 20, intermediary portions 22 may be provided, such as for example flat portions. These intermediary portions 22 may be transparent or colored, or may comprise some elements able to change the optical wavelengths emitted by the LED (such elements may include for example a luminescent material).

The body of the optical device 20 may be made of any material suitable for its optical function. Techniques of molding may for example be used to manufacture it.

Optionally the optical device 20 extends generally along a main surface, preferably a plane.

Figure 6:
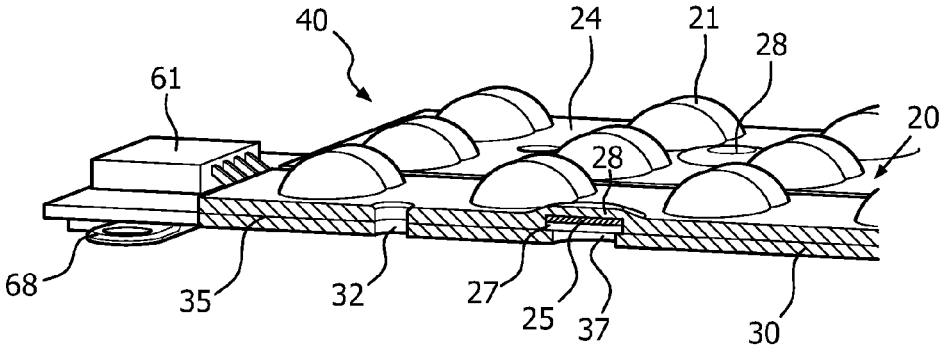
FIG. 6 is a top perspective view of a part of a light engine according to an exemplary embodiment of the invention.

The optical device 20 and the light-emitting device 30 are attached one to the other, along an interface 35. For a better adherence and attachment of the optical device 20 with the light-emitting device 30 at the interface 35, the optical device 20 has preferably a bottom main surface 23 with a shape generally complementary to the shape of a top surface 33 of the light-emitting device 30. Optionally, and as depicted in FIG. 6, these surfaces 23-33 are generally flat leading to a flat interface 35: latter configuration gives a rather flat and thin light engine 40 which extends generally according to the interface 35.

A first magnetic element 25 is located at the interface 35 between the optical device 20 and the light-emitting device 30. This first magnetic element 25 may be of a permanent magnet (e.g. NdFeB, Ferrite, AlNiCo, SmCo, etc.). Alternatively, this first magnetic element 25 may be of soft magnetic material (e.g. iron). Alternatively this first magnetic element may be an electromagnet, with possibly a core made of a soft magnetic material, which would be supplied and controlled through the circuit board of the light-emitting device 30.

Optionally an opened cavity 27 is provided in the bottom surface 23 of the optical device 20 so as to lodge the first magnetic element 25.

Optionally, the thickness of the first magnetic element 25 is greater than the thickness of the optical device 20, and a protrusion 28 is provided on the top surface 24 of the optical device 20 as a cap of the cavity 27 and of the first magnetic element 25. This protrusion or cap 28 may be attached to the optical device 20 after the manufacturing of the optical device 20 or can be made integrally with the optical device 20.

Figure 7A:
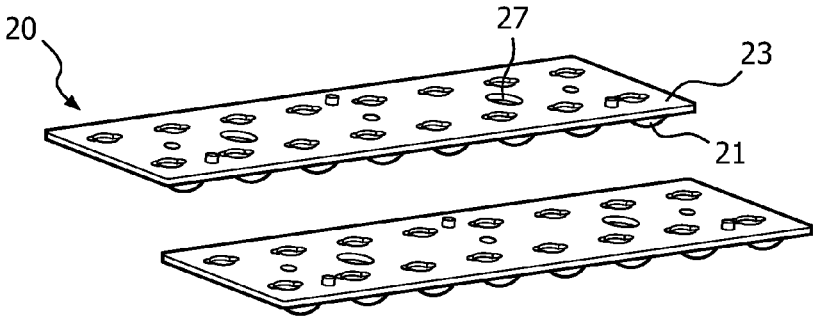
FIG. 7A, 7B, 7C are bottom perspective views of parts of a light engine according to an exemplary embodiment of the invention, depicting the assembly of the light engine according to successive steps.
Figure 7B:
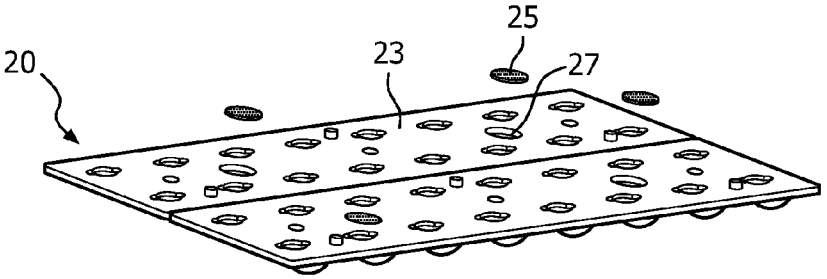
Figure 7C:
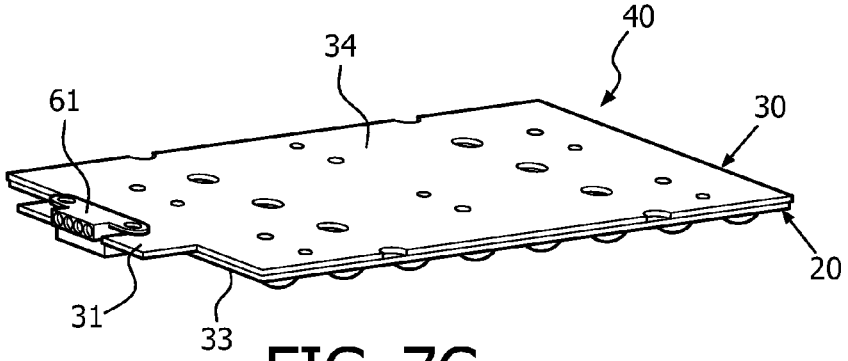

As depicted by the method of assembling the light-engine 40 according to FIG. 7A through 7C, each first magnetic element 25 is preferably positioned in a corresponding opened cavity 27 of the optical device 20, and then the top surface 33 of the light-emitting device 30 is attached to the bottom surface 23 of the optical device 20 such that the light-emitting device 30 closes at least partly each cavity 27. Therefore each first magnetic elements 25 is sandwiched between the optical device 20 and the light-emitting element 30 and cannot be removed accordingly. Optionally, the opened cavity 27 is designed so that the first magnetic element 25 fits within so as to be held. Possibly a layer of adhesive material might be added.

Alternatively to the opened cavity 27, a similar opened cavity (not shown) may be provided in the top surface 33 of the light-emitting device 30 so as to lodge in the same manner the first magnetic element 25. In this configuration, this is the optical device 20 which closes this opened cavity during assembling.

Alternatively (not shown), a first opened cavity 27 is provided in the bottom surface 23 of the optical device 20 and a second opened cavity, having a similar opening area to the first opened cavity 27, is provided in the top surface 33 of the light-emitting device 30 such that the first and second opened cavities face one to the other when the light-emitting device 30 and the optical device 20 are assembled: then the first magnetic element 25 is entirely housed by these two facing cavities. Optionally, such first and second opened cavities are designed so that the first magnetic element 25 fits within so as to be held. Possibly a layer of adhesive material might be added or not.

Figure 8A:
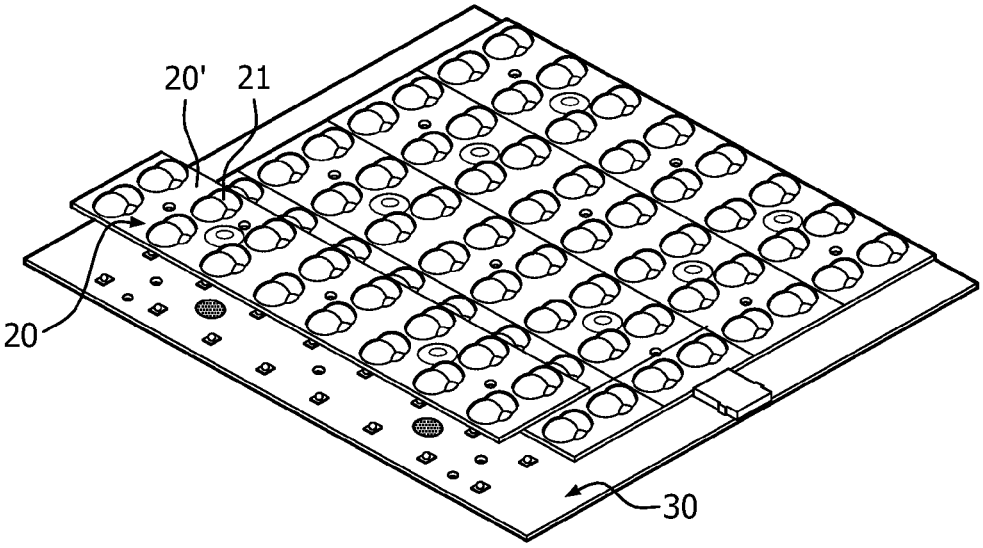
FIGS. 8A and 8B are respective top and bottom perspective views of a light engine according to an exemplary embodiment of the invention, depicting a way of assembling the optical device of the light engine to the circuit board of the light engine.
Figure 8B:
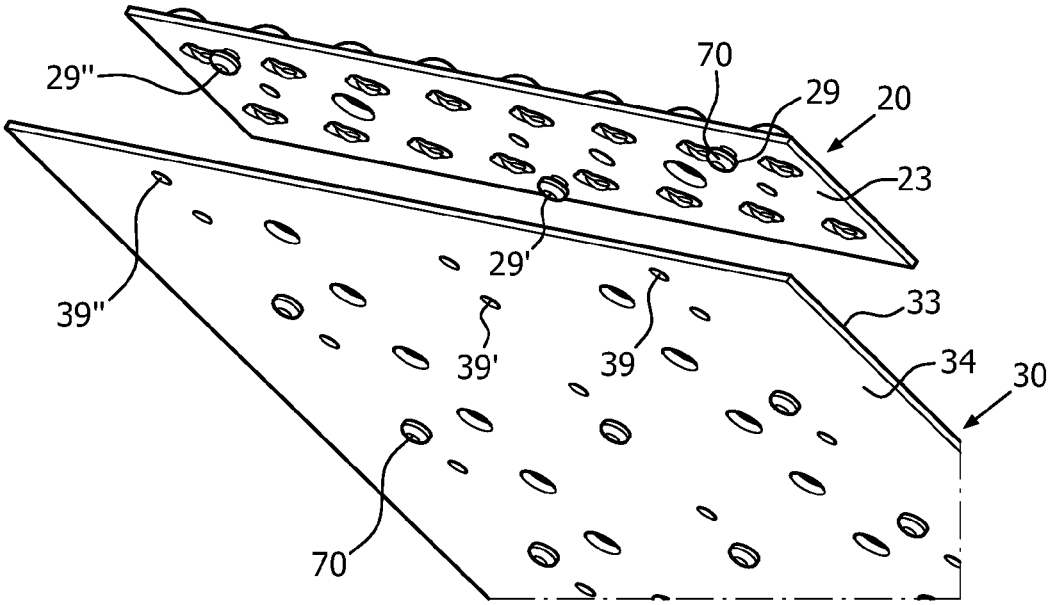

FIGS. 8A and 8B depict a method for attaching the optical device 20 to the light-emitting device 30 (once the first magnetic elements 25 are positioned at the interface 35), by providing on one hand pins 29, 29', 29" extending from the bottom surface 23 of the optical device 20 and on the other hand holes 39, 39', 39" through the light-emitting device 30 such that the pins 29, 29', 29" can go through the holes 39, 39', 39" when assembling. Once assembled, a terminal part 70 of each pin 29 protrudes from the corresponding hole 39 at the bottom surface 34 of the light-emitting device 30. This protruding part 70 of the pin 29 is then attached to the bottom surface 34 of the light-emitting device 30.

A welding may be used to attach these terminal parts 70 to the bottom surface 34 of the light-emitting device 30. Alternatively, another method of attaching the terminal parts 70 to the bottom surface 34 of the light-emitting device 30 may be implemented, such as for example gluing, ultrasonic bonding, etc.

Optionally, the said terminal parts 70 of the pins 29 are made of an elastic material and is wider than the remaining part of the pin 29 and than the corresponding hole 39: therefore the pins 29 are entered in force into the holes 39 until the terminal part 70 has entirely gone beyond the holes 39: then the optical device 20 may be held solely by these terminal parts 70. Optionally, a welding or another method of attaching the terminal parts 70 to the bottom surface of the light-emitting device 30 may be used to strengthen this attachment, and to ensure a good positioning of the optical device 20 with respect to the light-emitting device 30, and especially to the LEDs.

Optionally, the pins 29, 29', 29" are added after the optical device 20 and the light-emitting device 30 are put in close contact one onto the other, through corresponding facing holes 32 (see FIG. 6) provided in the optical device 20 and the light-emitting device 30. The method of attaching the pins 29, 29', 29" to the light engine 40 may comprise welding, pasting or other known methods.

As depicted in FIG. 8A, and according to this particular embodiment of the invention, the optical device 20 may be generally a board defining a matrix of lenses 21, the board being made from a plurality of adjacent optical strips 20', each optical strip 20' comprising several lenses 21. These optical strips 20' are attached side-by-side onto the light-emitting device 30 to form the entire optical device 20: this method may help the montage of the optical device 20 onto the light-emitting device 30.

Once assembled, the light engine 40 may be magnetically attached to a support holder 50 to form a light device 10 (see FIG. 1 through 5).

This support holder 50 mechanically rigidify the light device 10.

The support holder 50 may comprise means for dissipating the heat from the LEDs in operation. For example, the support holder may be made mainly of a good heat conductive material, such as for example Aluminium.

The support holder 50 may also comprise a magnetic material adapted such that the first magnetic elements 25 of the light engine 40 and this adapted magnetic material are magnetically attracted one to the other so as to magnetically attach the light engine 40 to the support holder 50.

Different adapted magnetic materials may be provided in the support holder 50, depending on the material chosen for the first magnetic element 25. If the first magnetic element 25 is a permanent magnet or an electromagnet, the adapted magnetic material may be a soft magnetic material. If the first magnetic element 25 is made of a first permanent magnet or an electromagnet having a first polarity, the adapted magnetic material may be a second permanent magnet having a second polarity having the same polarity as the first polarity. If the first magnetic element 25 is of a magnetically soft material, the adapted material may be a permanent magnet.

This adapted magnetic material can be coated on the support holder 50 or being powders embedded in the support holder 50.

According to the particular embodiment of this detailed description, the adapted magnetic material is comprised of second magnetic elements 55 facing the first magnetic elements 25. The user can therefore attach and remove very easily the light engine 40 from the support holder 50, without need of specific tool and adhesive materials.

These second magnetic elements 55 may be embedded in the support holder 50.

Alternatively, these second magnetic elements 55 are fixed to the support holder 50 through the top surface 54 of the support holder 50. To this effect some holes may be previously provided in this top surface 54.

These second magnetic elements 55 may be for example rivets or screws.

The top surface of the heads 59 of the second magnetic elements 55 may be coplanar with the top surface 54 of the support holder 50.

Figure 5:
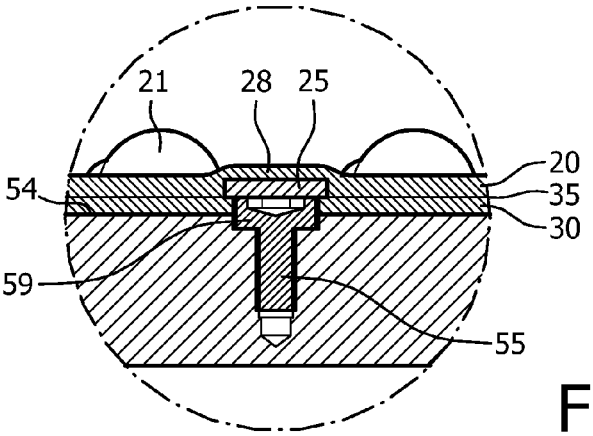
FIG. 5 is an enlargement view of the part 100 of FIG. 4.

Alternatively, the heads 59 may protrude from the top surface 54 of the support holder 50, such as depicted in FIG. 5. In latter case, a through hole 37 (see FIG. 6) is provided in the bottom surface 34 of the light-emitting device 30 so as to lodge these second magnetic elements 55: the first magnetic element 25 is therefore in close contact with the second magnetic element 55, maximizing accordingly the attractive force between the light engine 40 and the support holder 50. Moreover, the cooperation between the protruding heads 59 of the second magnetic elements 55 with the through holes 37 may help and assist a good positioning of the light engine 40 to the support holder 50.

As depicted in FIGS. 5 and 6, each through hole 37 has a mean diameter lower than the mean diameter of the corresponding opened cavity 27, to allow the first magnetic element 25 to be held after the optical device 20 is attached to the light-emitting device 30 (see FIG. 7A-7C).

A second connecting device 62 is optionally provided on the support holder 50 in order to be connected to the first connecting device 61 of the light engine 40 so as to form an electrical connector 60. The first connecting device 61 may include first plugging elements 63 (e.g. prongs) extending orthogonally to the main surface defined by the circuit board, and the second connecting device 62 may comprise second plugging elements 64 (e.g. holes) extending orthogonally to said surface, such that said first and second connecting elements 63-64 are respectively electrically connected one to the other when the light engine 40 is assembled onto the support holder 50.

Figure 2:
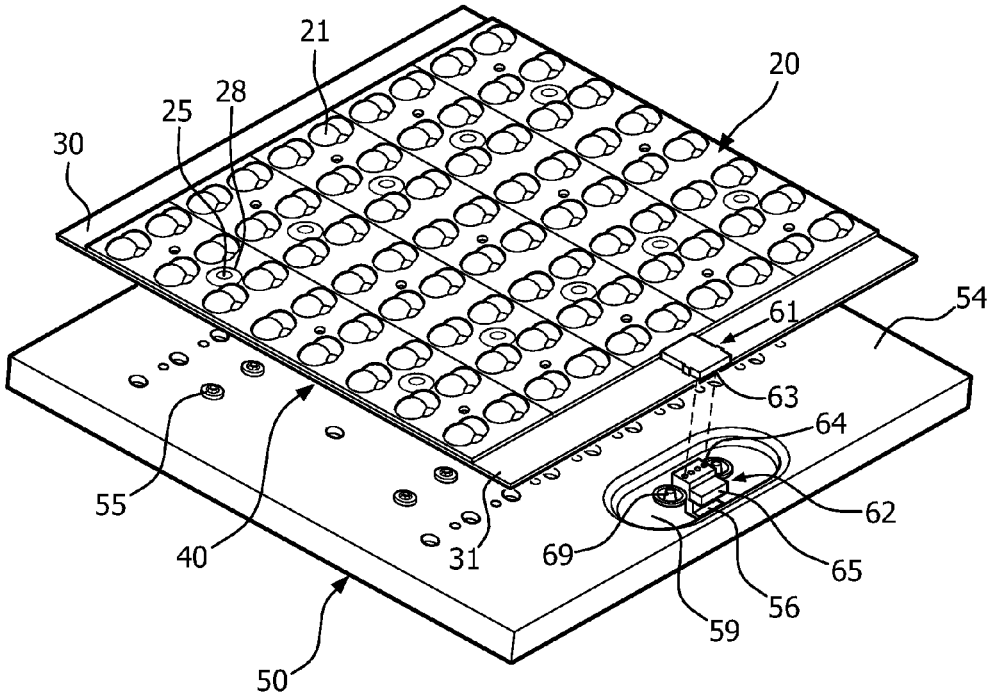
FIG. 2 is an exploded top perspective view of the light device according to FIG. 1, the light engine being separated from the heat sink.
Figure 3:
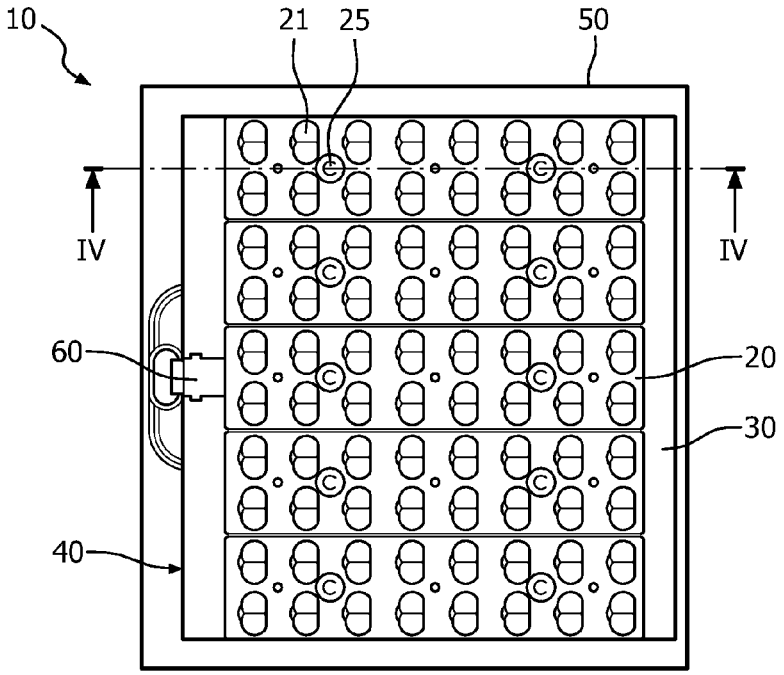
FIG. 3 is a top view of the light device according to FIG. 1.
Figure 4:
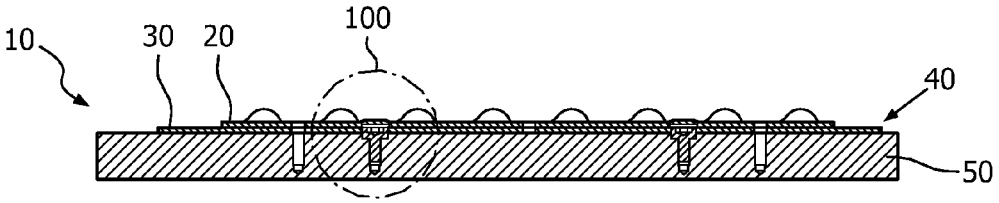
FIG. 4 is a cross-section view of the light-device of FIG. 1 according to the plane IV-IV of FIG. 3.

In this configuration, the said cooperation between the protruding heads 59 of the second magnetic elements 55 with the through holes 37 may help and assist a good electrical connection between the first connecting device 61 and the second connecting device 62, as depicted in FIG. 2.

To secure the connection between the first and second connecting device 61-62, supplementary means of attachment 68-69 may be provided (see FIG. 2 and FIG. 6).

An opened cavity 59 having a height similar to the second connecting device 62 may be provided on the top surface 54 of the support holder 50 to bear the second connecting device 62. This opened cavity 59 avoids that the second connecting device 62 protrudes from the top surface 54 of the support holder 50, and therefore hampers the attachment of the light engine 40 to the support holder 50. Moreover through holes 56 may be provided through a bottom portion of the opened cavity 59, to allow some supply and/or control wires to go through and being connected to supply and/or control ports 65 of the second connecting device 62.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the light engine comprises an optical device provided with only one lens, a light-emitting device comprising only one light source (e.g. LED) and one or a plurality of first magnetic element(s) sandwiched between the optical device and the light-emitting device, according to the invention.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality.

The invention claimed is:

1. A light device comprising:

a light engine, comprising:

a light-emitting device comprising at least one light source;

an optical device attached to the light-emitting device; and at least one first magnetic element disposed between the light-emitting device and the optical device; and a support holder arranged to bear the light engine, comprising a magnetic material adapted such that the at least one first magnetic element of the light engine and this magnetic material are magnetically attracted one to the other to magnetically attach the light engine to the support holder, wherein the light-emitting device comprises a circuit board and wherein the at least one light source is a LED, the circuit board comprising a first connecting device comprising plugging elements extending orthogonally to a surface defined by the circuit board.

2. A light device comprising:

a light engine, comprising:

a light-emitting device comprising at least one light source;

an optical device attached to the light-emitting device; and at least one first magnetic element disposed between the light-emitting device and the optical device; and a support holder arranged to bear the light engine, comprising a magnetic material adapted such that the at least one first magnetic element of the light engine and this magnetic material are magnetically attracted one to the other to magnetically attach the light engine to the support holder, wherein the light source(s) is (are) LED(s) and wherein the light-emitting device of the light engine includes a circuit board comprising a first connecting device including first plugging elements extending orthogonally to a surface defined by the circuit board, and wherein the support holder comprises a second connecting device comprising plugging elements extending orthogonally to said surface, such one of said first and second connecting elements is respectively electrically connected to the other when the light engine is assembled to the support holder.

3. A light device comprising:

a light engine, comprising:

a light-emitting device comprising at least one light source;

an optical device attached to the light-emitting device; and at least one first magnetic element disposed between the light-emitting device and the optical device; and a support holder arranged to bear the light engine, comprising a magnetic material adapted such that the at least one first magnetic element of the light engine and this magnetic material are magnetically attracted one to the other to magnetically attach the light engine to the support holder, wherein at least one protruding element protrudes from the surface of the support holder located at the interface with the light engine, and wherein the surface of the light engine located at the interface with the support holder comprises at least one opened cavity designed to house the protruding element.

4. The light device according to claim 3, wherein the magnetic material is comprised of at least one second magnetic element facing one first magnetic element, wherein at least one said protruding element is protruding part of a second magnetic element.

5. The light device according to claim 3, wherein the light source(s) is (are) LED(s) and wherein the light-emitting device of the light engine includes a circuit board comprising a first connecting device including first plugging elements extending orthogonally to a surface defined by the circuit board, and wherein the support holder comprises a second connecting device comprising plugging elements extending orthogonally to said surface, such one of said first and second connecting elements is respectively electrically connected to the other when the light engine is assembled to the support holder.

6. The light device according to claim 3, wherein the at least one first magnetic element is secured between the light-emitting device and the optical device.

7. The light device according to claim 3, wherein at least one of the optical device and the light-emitting device define at least one open cavity for receiving the first magnetic element therein.

8. The light device according to claim 3, wherein the light-emitting device comprises a circuit board and wherein the at least one light source is a LED, the circuit board comprising a first connecting device comprising plugging elements extending orthogonally to a surface defined by the circuit board.

9. The light device according to claim 3, wherein the optical device comprises at least one lens facing at least one light source.

10. The light device according to claim 3, wherein the magnetic material is comprised of at least one second magnetic element facing one first magnetic element.

11. The light device according to claim 10, wherein at least one first magnetic element is made of a permanent magnet and at least one second magnetic element is made of a magnetic soft material.

* * * * *